US010330367B2

(12) United States Patent
Thayyullathil et al.

(10) Patent No.: US 10,330,367 B2
(45) Date of Patent: Jun. 25, 2019

(54) REFRIGERATOR HINGE BRACKET MECHANISM

(71) Applicant: Viking Range, LLC, Greenwood, MS (US)

(72) Inventors: Jemsheer Thayyullathil, Greenwood, MS (US); David Hensel, Boston, MA (US); Philip Carbone, North Reading, MA (US)

(73) Assignee: VIKING RANGE, LLC, Greenwood, MS (US)

( * ) Notice: Subject to any disclaimer, the term of this patent is extended or adjusted under 35 U.S.C. 154(b) by 86 days.

(21) Appl. No.: 15/405,682

(22) Filed: Jan. 13, 2017

(65) Prior Publication Data

US 2017/0205135 A1 Jul. 20, 2017

Related U.S. Application Data

(60) Provisional application No. 62/278,792, filed on Jan. 14, 2016.

(51) Int. Cl.
*F25D 23/02* (2006.01)
*F25C 5/182* (2018.01)
(Continued)

(52) U.S. Cl.
CPC ..... *F25C 5/182* (2013.01); *E05D 5/06* (2013.01); *E05D 7/0415* (2013.01); *F25D 11/00* (2013.01);
(Continued)

(58) Field of Classification Search
CPC ..... F25C 5/182; E05D 5/06; E05D 7/0415; E05D 2007/0469; E05Y 2900/20; E05Y 2900/31; F25D 2323/0024; F25D 23/028
(Continued)

(56) References Cited

U.S. PATENT DOCUMENTS 3,325,942 A * 6/1967 Bejarano ..... E05D 7/0423 16/245
3,890,670 A * 6/1975 Sewing ..... E05D 7/0407 16/236

(Continued)

*Primary Examiner* — Daniel J Troy
*Assistant Examiner* — Timothy M Ayres
(74) *Attorney, Agent, or Firm* — Baker Donelson; Dorian B. Kennedy

(57) ABSTRACT

A refrigerator door hinge bracket mechanism (40) has a door mounting assembly (45) and a base mounting assembly (46). The door mounting assembly includes a hinge mounting plate (49). The base mounting assembly includes an adjustment mechanism (52) which has a U-shaped adjustment plate (50) coupled to the hinge mounting plate, a threaded lower adjustment bar (55) with a threaded lower adjustment block (56) and which has a top camming surface (58), a threaded upper adjustment bar (60) with a threaded upper adjustment block (61) which has a lower cam following surface (63) configured to mate with camming surface. The upper adjustment block includes opening (64) therethrough which aligns with an opening (65) extending through adjustment plate and a hole (66) in the hinge mounting plate. A threaded bolt (67) passes through the three holes to mount the adjustment mechanism to the hinge mounting plate with adjustable movement therebetween.

11 Claims, 3 Drawing Sheets

(51) Int. Cl.
*E05D 5/06* (2006.01)
*E05D 7/04* (2006.01)
*F25D 11/00* (2006.01)

(52) U.S. Cl.
CPC .... *F25D 23/028* (2013.01); *E05D 2007/0469* (2013.01); *E05Y 2900/31* (2013.01); *F25D 2323/024* (2013.01)

(58) Field of Classification Search
USPC ..... 312/405
See application file for complete search history.

(56) References Cited

U.S. PATENT DOCUMENTS 6,070,300 A * 6/2000 Shin ..... E05D 7/1044 16/382
6,681,446 B2 * 1/2004 Compagnucci ..... A47B 96/06 16/236
7,703,727 B2 * 4/2010 Selness ..... A47B 91/028 248/125.2
8,506,026 B2 * 8/2013 Kim ..... F25D 23/028 312/405
8,578,558 B2 * 11/2013 Bonomie ..... E05D 7/0423 16/238
8,752,921 B2 * 6/2014 Gorz ..... F25D 23/062 312/406.2
8,925,258 B1 * 1/2015 Header ..... E05D 15/00 16/90
8,938,854 B2 * 1/2015 Lanzani ..... E05D 3/14 16/288
9,341,011 B2 * 5/2016 Haab ..... E05D 15/0634
9,376,848 B2 * 6/2016 Terno ..... E05D 15/0652
9,605,457 B2 * 3/2017 Humble ..... E05D 7/04
9,752,817 B2 * 9/2017 Richards ..... F25D 23/028
2017/0198507 A1 * 7/2017 Humble ..... E05D 7/04

* cited by examiner

REFRIGERATOR HINGE BRACKET MECHANISM

REFERENCE TO RELATED APPLICATION

Applicant claims the benefit of U.S. Provisional Patent Application Ser. No. 62/278,792 filed Jan. 14, 2016.

TECHNICAL FIELD

This invention relates generally to refrigerator components, and more particularly to a hinge mechanism of a refrigerator.

BACKGROUND OF INVENTION

Refrigerators have existed for decades. Refrigerators typically include an enclosed base or main housing and a door pivotally mounted to the main housing. Many of today's refrigerators are designed to be mounted flush with the adjoining cabinetry to provide a custom look with the refrigerator door placed very close to the cabinetry. A problem associated with such a design is that the door hits the cabinet when it is swung open.

A solution to the problem of the refrigerator door hitting the adjoining cabinet has been to include a hinge which moves the door outwardly away from the main housing prior to the door pivoting, thus allowing the door to clear the cabinet. This type of hinge is shown in U.S. Pat. No. 8,938,854 which is specifically included herein by reference in its entirety. However, a problem with this type of hinge is that the door cannot be easily adjusted vertically or horizontally should the door be misaligned from the main housing. Another problem has been that the door may be slammed against the main housing with such as force as to cause food items placed on the inside shelves of the door to be dislodged or damaged. The slamming of the door may also cause unnecessary wear and tear upon the components of the refrigerator.

Accordingly, it is seen that a need remains for a refrigerator hinge which can allow vertical and horizontal adjustments as well as preventing the slamming of the refrigerator door against the main housing. It is to the provision of such therefore that the present invention is primarily directed.

DETAILED DESCRIPTION

Figure 1:
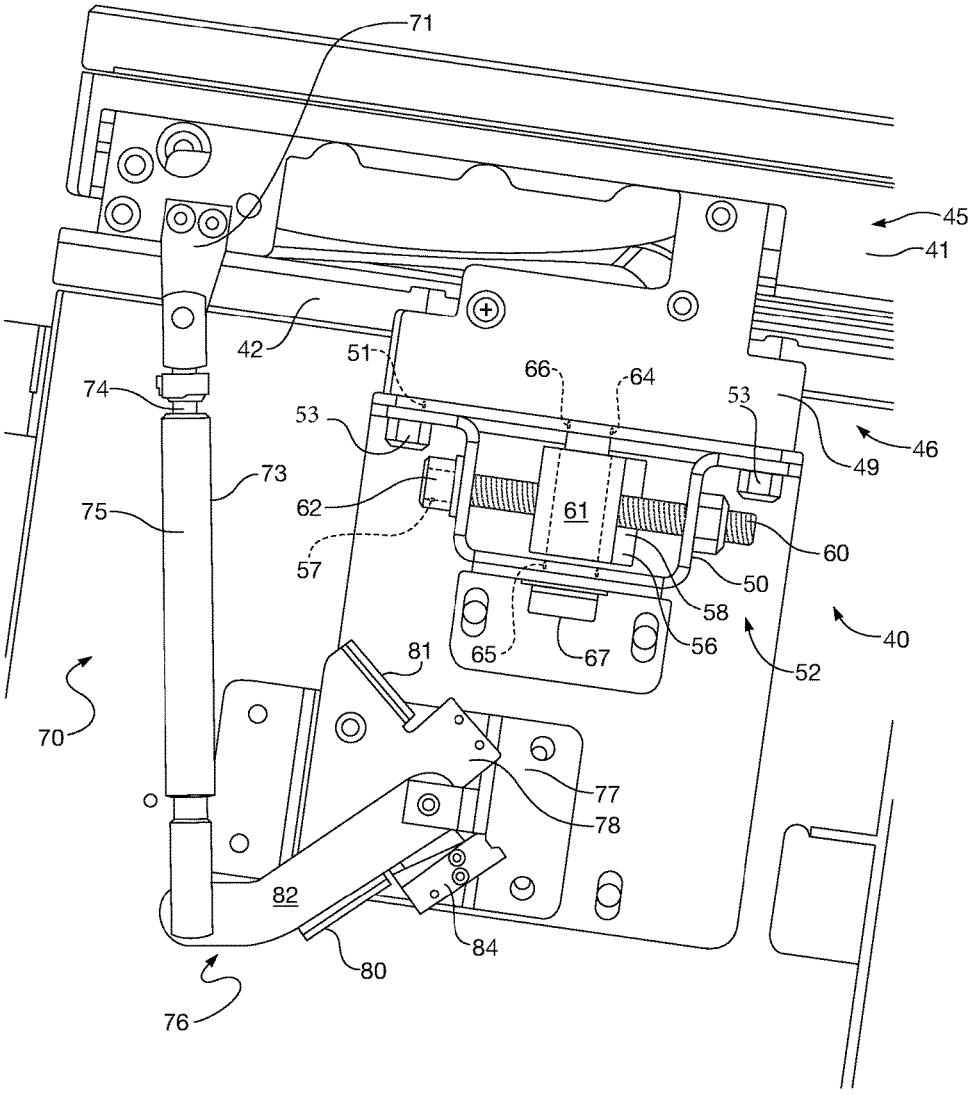
FIG. 1 is a top view of a refrigerator door hinge bracket mechanism embodying principles of the invention in a preferred form, shown with portions of a refrigerator door and main housing.
Figure 2:
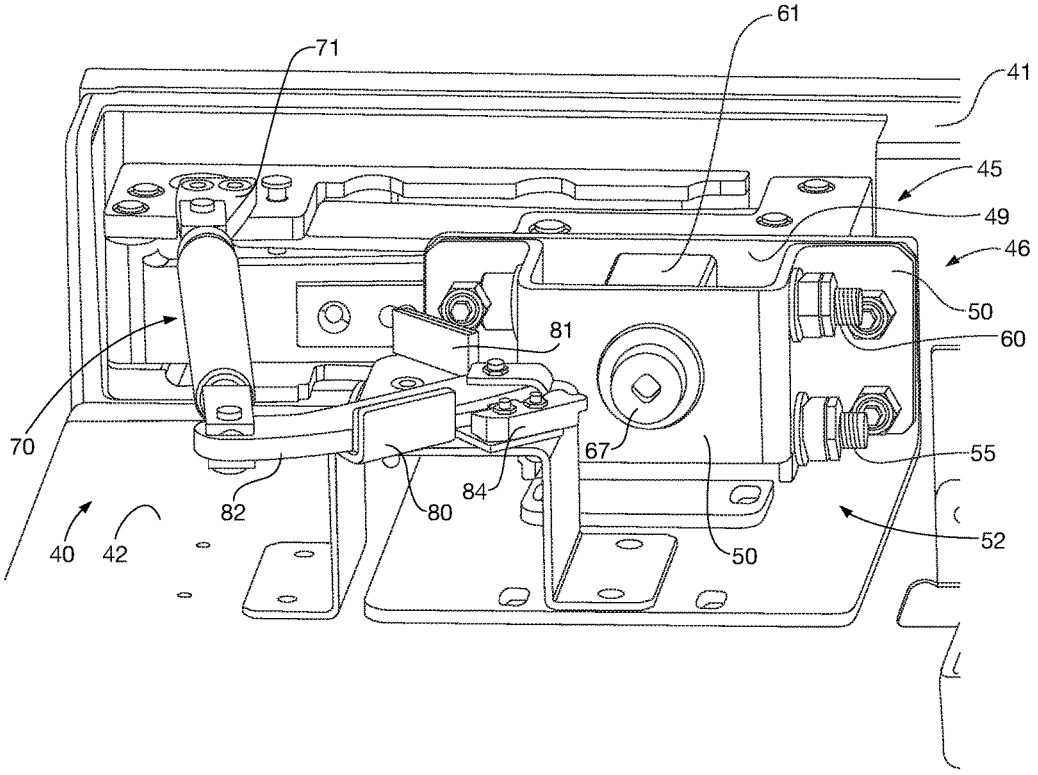
FIG. 2 is a perspective view of the refrigerator door hinge bracket mechanism of FIG. 1, shown in door closed configuration, shown with portions of a refrigerator door and main housing.
Figure 3:
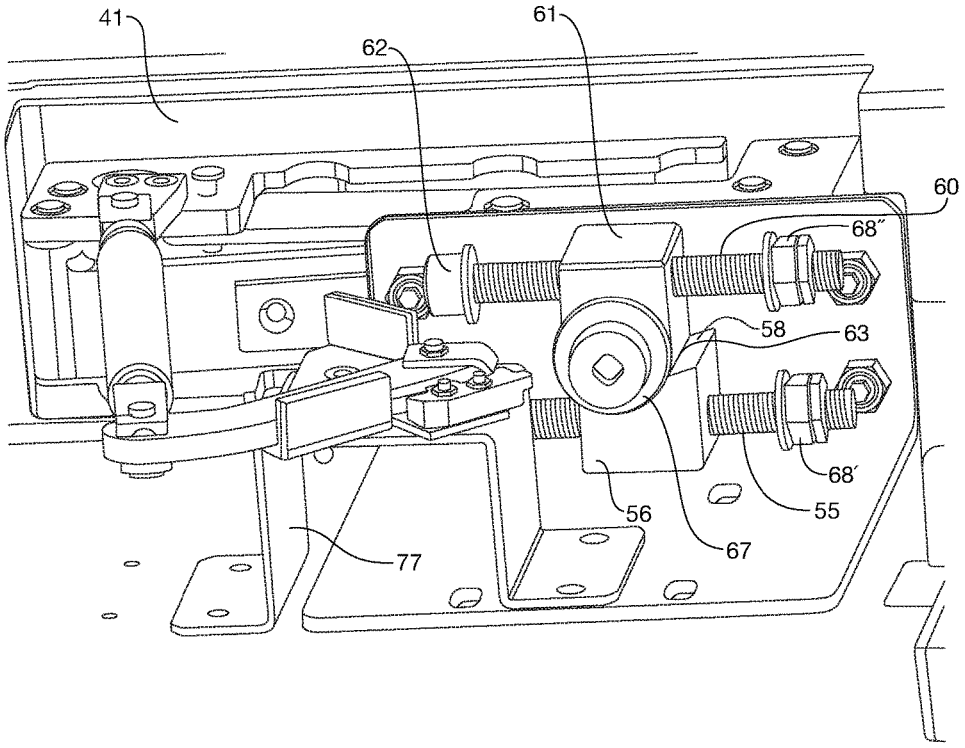
FIG. 3 is a perspective view of the refrigerator door hinge bracket mechanism of FIG. 1, shown in door closed configuration and with an adjustment plate removed for clarity, shown with portions of a refrigerator door and main housing.

With reference next to the drawings, there is shown a door hinge bracket mechanism 40 according to the present invention. The door hinge bracket mechanism 40 in combination with a conventional hinge or hinge body H enables outward movement and then pivotal movement of the refrigerator door 41 relative to the main housing 42. The door hinge bracket mechanism 40 includes a door mounting assembly 45 coupled to the refrigerator door 41 and a base mounting assembly 46 coupled to the refrigerator main housing 42. The door mounting assembly 45 includes a hinge mounting plate 49. The design of the door mounting assembly 45 includes a conventional hinge H which is similar to hinges that have already been designed, such those shown in U.S. Pat. No. 8,938,854 which is specifically incorporated herein by reference. These types of hinges are designed so that the door moves outwardly away from the refrigerator main housing 42 prior to pivoting relative to the refrigerator main housing, which enables the door to be mounted closely adjacent to the cabinetry without the door hitting the cabinetry upon opening. However, it should be understood that the present hinge bracket mechanism 40 may be coupled to any type of hinge and is not limited to the hinge H shown in the preferred embodiment.

The base mounting assembly 46 includes an adjustment mechanism 52 which allows for vertical and horizontal adjustments of the refrigerator door 41 relative to the refrigerator main housing 42. The door adjustment mechanism 52 includes a U-shaped adjustment plate 50 coupled to the hinge mounting plate 49 for both horizontal and vertical movement relative to the adjustment plate 50. The adjustment plate 50 has oversized holes or openings 51 through which mounting bolts 53 extend and are threaded into hinge mounting plate 49.

The adjustment mechanism 52 also includes a threaded lower adjustment bar 55 extending through holes or openings 59' within the adjustment plate 50 and upon which is threaded a lower adjustment block 56 which moves along threaded lower adjustment bar 55 through rotation of the threaded lower adjustment bar 55. The lower adjustment bar 55 has a head 57 with a conventional socket adapted to receive a corresponding turning tool. The threaded end of the adjustment bar 55 opposite the head 57 receives an internally threaded nut 68'. The lower adjustment block 56 includes a top surface which is angled or sloped to provide a camming surface 58.

The adjustment mechanism 52 also includes a threaded upper adjustment bar 60 extending through elongated holes or openings 59" within the adjustment plate 50 and upon which is threaded an upper adjustment block 61 which moves along threaded upper adjustment bar 60 with rotation of the threaded upper adjustment bar 60. The upper adjustment bar 60 has a head 62 with a conventional socket adapted to receive a corresponding turning tool. The threaded end of the adjustment bar 60 opposite the head 62 receives an internally threaded nut 68". The upper adjustment block 60 includes a lower surface which is angled or sloped to provide a cam following surface 63 configured to mate with camming surface 58 of the lower adjustment block 56.

The upper adjustment block 61 includes a hole or opening 64 therethrough which aligns with a hole or opening 65 extending through adjustment plate 50 and a hole 66 in the hinge mounting plate 49. A threaded bolt 67 passes through the three holes to mount the adjustment mechanism 52 to the hinge mounting plate 49 with limited adjustable movement therebetween. The adjustment plate hole 65 may be oblong or oversized to enable limited movement for adjustment purposes.

In use, with the mounting bolts 53 loosened to allow limited movement between the hinge mounting plate 49 and the adjustment plate 50 and the threaded nut 68" loosened to allow limited movement between the upper adjustment bar 60 and the adjustment plate 50, the rotation of the lower adjustment bar 55 causes the lower adjustment block 56 to move laterally or horizontally along the lower adjustment bar 55. The lateral movement of the lower adjustment block 56 causes its camming surface 58 to bear upon the cam following surface 63 of the upper adjustment block 61, which in turn causes the upper adjustment block 61 to move vertically. The vertical movement of the upper adjustment block 61 causes the hinge mounting plate 49 to move vertically, resulting in the vertical adjustment of the hinge and refrigerator door 41 mounted thereto.

Rotation of the upper adjustment bar 60 causes the upper adjustment block 61 to move laterally or horizontally. The lateral movement of the upper adjustment block 61 causes the lateral movement of the hinge mounting plate 49, resulting in the horizontal adjustment of the refrigerator door 41 relative to the refrigerator main housing 42. Thus, through coordinated rotation of the upper and lower adjustment bars and their resulting movement of the upper and lower adjustment blocks the refrigerator door may be adjusted both vertically and horizontally until it is properly seated against or in alignment the main housing 42 of the refrigerator.

Once the adjustment bars 55 and 60 and their accompanying adjustment blocks 56 and 61 are properly positioned to provide the correct alignment of the door with the main housing 42, the mounting bolts 52 are tightened to lock or prevent relative movement between the hinge mounting plate 49 and adjustment plate 50. Similarly, the threaded bolts 68' and 68" are tightened to prevent movement of the upper adjustment bar 60 relative to the adjustment plate 50.

The door hinge bracket mechanism 40 also includes a novel dampening system 70 for preventing the door 41 from being slammed against the main housing 42 when the door 41 is closed. The dampening system 70 includes a door dampening plate 71 coupled to the hinge H distally the hinge mounting plate 49 and pivotally coupled to a conventional gas, pneumatic, or fluid dampener 73. The dampener 73 is of conventional construction having a piston 74 reciprocally mounted within a cylinder 75 to resist or slow the insertion of the piston 74 into the cylinder 75.

The dampening system 70 also includes a lever assembly 76 pivotally coupled to the end of the dampener 73 opposite the door dampening plate 71. The lever assembly 76 includes a base 77 to which is mounted a limiting plate 78. The limiting plate 78 has a door fully closed position first stop 80 and a door partially opened position second stop 81. A pivotal lever 82 is coupled to the limiting plate 78 for pivotal movement between a door fully closed position contacting first stop 80 and a door partially opened position contacting second stop 81. A door open switch or indicator 84 is mounted adjacent the first stop 80 so that the lever 82 contacts the indicator 84 when the door is in its fully closed position shown in FIG. 1.

In use, as the door is moved from its closed position towards its open position the lever 82 of the lever assembly 76 pivots from its door fully closed position adjacent first stop 80 to its door partially opened position adjacent the second stop 81. With the lever 82 abutting the second stop 81 and the continued opening movement of the door 41 the dampener piston 74 is withdrawn from the dampener cylinder 75.

When the door is moved from its open position towards its closed position, the dampener piston 74 moves back into the dampener cylinder 75. This movement of the piston 74 is restricted or slowed by the dampener so that the door cannot be slammed shut, i.e., the dampener limits the speed of the door closing. Once the piston 74 is fully retracted into the cylinder 75, the lever 82 then pivotally moves back from its door partially opened position abutting the second stop 81 to its door fully closed position adjacent first stop 80. As the door is fully closed, the lever 82 contacts the switch 84 which causes the actuation of door closed actions, such as the interior light being turned off, the actuation of any vacuum pump to evacuate the interior air of the refrigerator, actuation of the compressor pump, and/or any other function commonly associated with the closing of a refrigerator door. The placement of the switch 84 within the hinge mechanism differs from the prior art which includes the switch mounted on the door jamb so that the door itself actuates the switch. The new design removes the switch from the door jamb where it is not only improves the aesthetics of the refrigerator by removing the switch from view, but also places the switch in an area wherein it is not susceptible to moisture condensing upon the switch through the fluctuation in temperatures associated with the opening and closing of the refrigerator door 41.

It thus is seen that a hinge and dampener for a refrigerator is now provided which overcomes problems associated with the prior art. While this invention has been described in detail with particular references to the preferred embodiments thereof, it should be understood that many modifications, additions and deletions, in addition to those expressly

The invention claimed is:

1. A hinge bracket mechanism for use with a hinge for a refrigerator door, said hinge bracket mechanism comprising, a hinge mounting plate mountable to a refrigerator door hinge;

an adjustment plate coupled to said hinge mounting plate for limited relative movement therebetween;

a lower adjustment block separate and apart from said hinge mounting plate and said adjustment plate, said lower adjustment block being coupled to said adjustment plate for relative movement therebetween, said lower adjustment block having an upper camming surface, said lower adjustment block being movable laterally relative to said adjustment plate;

an upper adjustment block separate and apart from said hinge mounting plate and said adjustment plate, said upper adjustment block being coupled to said adjustment plate for relative movement therebetween, said upper adjustment block being coupled to said hinge mounting plate for relative movement therebetween, said upper adjustment block having a lower cam following surface configured to ride upon said upper camming surface of said lower adjustment block to impart vertical movement of said upper adjustment block through lateral movement of said lower adjustment block, said upper adjustment block being movable laterally relative to said adjustment plate to impart lateral movement of said hinge mounting plate relative to said adjustment plate, wherein said lower adjustment block is threadably coupled to a threaded lower adjustment bar mounted to said adjustment plate, wherein said upper adjustment block is threadably coupled to a threaded upper adjustment bar mounted to said adjustment plate, wherein said upper adjustment block includes an opening therethrough, wherein said adjustment plate has an oversized hole therethrough, and said hinge bracket mechanism further comprises a mounting bolt extending through said adjustment plate oversized hole, extending through said upper adjustment block opening, and coupled to said hinge mounting plate, whereby lateral movement of the lower adjustment block causes vertical movement of the upper adjustment block, the hinge mounting plate coupled to the upper adjustment block, and the hinge coupled to the hinge mounting plate, and whereby lateral movement of the upper adjustment block causes lateral movement of the hinge mounting plate and the hinge coupled to the hinge mounting plate, whereby rotational movement of the lower adjustment bar causes lateral movement of the lower adjustment block, and whereby rotational movement of the upper adjustment bar causes lateral movement of the upper adjustment block.

2. A hinge bracket mechanism for use with a hinge for a refrigerator door, said hinge bracket mechanism comprising, a hinge mounting plate mountable to a refrigerator door hinge;

an adjustment plate coupled to said hinge mounting plate for limited relative movement therebetween;

a lower adjustment block separate and apart from said hinge mounting plate and said adjustment plate, said lower adjustment block being coupled to said adjustment plate for relative movement therebetween, said lower adjustment block having an upper camming surface, said lower adjustment block being movable laterally relative to said adjustment plate;

an upper adjustment block separate and apart from said hinge mounting plate and said adjustment plate, said upper adjustment block being coupled to said adjustment plate for relative movement therebetween, said upper adjustment block being coupled to said hinge mounting plate for relative movement therebetween, said upper adjustment block having a lower cam following surface configured to ride upon said upper camming surface of said lower adjustment block to impart vertical movement of said upper adjustment block through lateral movement of said lower adjustment block, said upper adjustment block being movable laterally relative to said adjustment plate to impart lateral movement of said hinge mounting plate relative to said adjustment plate, and a coupler mounted to said hinge mounting plate and said adjustment plate which can fix the relative position of said adjustment plate relative to said hinge mounting plate, whereby lateral movement of the lower adjustment block causes vertical movement of the upper adjustment block, the hinge mounting plate coupled to the upper adjustment block, and the hinge coupled to the hinge mounting plate, and whereby lateral movement of the upper adjustment block causes lateral movement of the hinge mounting plate and the hinge coupled to the hinge mounting plate.

3. The hinge bracket mechanism of claim 2 wherein said coupler is at least one threaded bolt.

4. A hinge bracket mechanism for use with a hinge for pivotally coupling a refrigerator door to a refrigerator main housing, said hinge bracket mechanism comprising, a hinge mounting plate mountable to a refrigerator door hinge coupled to a refrigerator door;

an adjustment plate coupled to said hinge mounting plate for limited relative movement therebetween and coupled to the main housing of a refrigerator;

a cam separate and apart from said adjustment plate and coupled to said adjustment plate for relative movement therebetween;

an cam follower separate and apart from said adjustment plate and coupled to said adjustment plate and to said hinge mounting plate, said cam follower configured to ride upon said cam to impart vertical movement of said cam follower, said cam follower being movable relative to said adjustment plate to impart horizontal movement of said hinge mounting plate relative to said adjustment plate, wherein said cam is threadably coupled to a threaded first adjustment bar mounted to said adjustment plate, wherein said cam follower is threadably coupled to a threaded second adjustment bar mounted to said adjustment plate, wherein said cam follower includes an opening therethrough, wherein said adjustment plate has an oversized hole therethrough, and said hinge bracket mechanism further comprises a mounting bolt extending through said adjustment plate oversized hole, extending through said cam follower opening, and coupled to said hinge mounting plate, whereby movement of the cam causes vertical movement of the cam follower, the hinge mounting plate coupled to the cam follower, and the hinge coupled to the hinge mounting plate, and whereby horizontal movement of the cam follower causes horizontal movement of the hinge mounting plate and the hinge coupled to the hinge mounting plate, whereby rotational movement of the first adjustment bar causes horizontal movement of the cam, whereby rotational movement of the second adjustment bar causes horizontal movement of the cam follower.

5. A hinge bracket mechanism for use with a hinge for pivotally coupling a refrigerator door to a refrigerator main housing, said hinge bracket mechanism comprising, a hinge mounting plate mountable to a refrigerator door hinge coupled to a refrigerator door;

an adjustment plate coupled to said hinge mounting plate for limited relative movement therebetween and coupled to the main housing of a refrigerator;

a cam separate and apart from said adjustment plate and coupled to said adjustment plate for relative movement therebetween;

a cam follower separate and apart from said adjustment plate and coupled to said adjustment plate and to said hinge mounting plate, said cam follower configured to ride upon said cam to impart vertical movement of said cam follower, said cam follower being movable relative to said adjustment plate to impart horizontal movement of said hinge mounting plate relative to said adjustment plate, a coupler mounted to said hinge mounting plate and said adjustment plate which can fix the relative position of said adjustment plate relative to said hinge mounting plate, whereby movement of the cam causes vertical movement of the cam follower, the hinge mounting plate coupled to the cam follower, and the hinge coupled to the hinge mounting plate, and whereby horizontal movement of the cam follower causes horizontal movement of the hinge mounting plate and the hinge coupled to the hinge mounting plate.

6. The hinge bracket mechanism of claim 5 wherein said coupler is at least one threaded bolt.

7. A refrigerator comprising, a main housing;

a door, and a hinge pivotally coupling said door to said main housing, said hinge having a hinge body, a hinge mounting plate coupled to said hinge body, an adjustment plate coupling said hinge mounting plate to said main housing for limited relative movement therebetween, a first adjustment block coupled to said adjustment plate, said first adjustment block having an first camming surface, said first adjustment block being movable laterally relative to said adjustment plate, a second adjustment block coupled to said adjustment plate and to said hinge mounting plate, said second adjustment block having a second camming surface configured to ride upon said first camming surface of said first adjustment block to impart vertical movement of said second adjustment block through lateral movement of said first adjustment block, said second adjustment block being movable laterally relative to said adjustment plate to impart lateral movement of said hinge mounting plate relative to said adjustment plate, said second adjustment block includes an opening therethrough, wherein said adjustment plate has an oversized hole therethrough, and said hinge further comprises a mounting bolt extending through said adjustment plate oversized hole, extending through said second adjustment block opening, and coupled to said hinge mounting plate, whereby lateral movement of the first adjustment block causes vertical movement of the second adjustment block, the hinge mounting plate coupled to the second adjustment block, and the hinge coupled to the hinge mounting plate, and whereby lateral movement of the second adjustment block causes lateral movement of the hinge mounting plate and the hinge coupled to the hinge mounting plate.

8. The refrigerator of claim 7 wherein said first adjustment block is threadably coupled to a threaded first adjustment bar mounted to said adjustment plate, whereby rotational movement of the first adjustment bar causes lateral movement of the first adjustment block.

9. The refrigerator of claim 8 wherein said second adjustment block is threadably coupled to a threaded second adjustment bar mounted to said adjustment plate, whereby rotational movement of the second adjustment bar causes lateral movement of the second adjustment block.

10. The refrigerator of claim 7 wherein said second adjustment block is threadably coupled to a threaded second adjustment bar mounted to said adjustment plate, whereby rotational movement of the second adjustment bar causes lateral movement of the second adjustment block.

11. A refrigerator comprising, a main housing;

a door, and a hinge pivotally coupling said door to said main housing, said hinge having a hinge body, a hinge mounting plate coupled to said hinge body, an adjustment plate coupling said hinge mounting plate to said main housing for limited relative movement therebetween, a first adjustment block coupled to said adjustment plate, said first adjustment block having an first camming surface, said first adjustment block being movable laterally relative to said adjustment plate, a second adjustment block coupled to said adjustment plate and to said hinge mounting plate, said second adjustment block having a second camming surface configured to ride upon said first camming surface of said first adjustment block to impart vertical movement of said second adjustment block through lateral movement of said first adjustment block, said second adjustment block being movable laterally relative to said adjustment plate to impart lateral movement of said hinge mounting plate relative to said adjustment plate, a coupler mounted to said hinge mounting plate and said adjustment plate which can fix the relative position of said adjustment plate relative to said hinge mounting plate, whereby lateral movement of the first adjustment block causes vertical movement of the second adjustment block, the hinge mounting plate coupled to the second adjustment block, and the hinge coupled to the hinge mounting plate, and whereby lateral movement of the second adjustment block causes lateral movement of the hinge mounting plate and the hinge coupled to the hinge mounting plate.

* * * * *